US010099829B2

(12) United States Patent
Brandao et al.

(10) Patent No.: US 10,099,829 B2
(45) Date of Patent: Oct. 16, 2018

(54) INFANT FORMULA CONTAINER WITH COMPARTMENT AND LID

(71) Applicant: NESTEC S.A., Vevey (CH)

(72) Inventors: Sophia Brandao, Murten (CH); Elodie Richard, Chardonne (CH)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 15/507,034

(22) PCT Filed: Aug. 26, 2015

(86) PCT No.: PCT/EP2015/069476
§ 371 (c)(1),
(2) Date: Feb. 27, 2017

(87) PCT Pub. No.: WO2016/030395
PCT Pub. Date: Mar. 3, 2016

(65) Prior Publication Data

US 2017/0275066 A1 Sep. 28, 2017

(30) Foreign Application Priority Data

Aug. 29, 2014 (EP) ..... 14182844

(51) Int. Cl.
*B65D 51/28* (2006.01)
*B65D 51/24* (2006.01)

(52) U.S. Cl.
CPC ..... *B65D 51/247* (2013.01); *B65D 51/28* (2013.01); *B65D 51/24* (2013.01); *B65D 2201/00* (2013.01)

(58) Field of Classification Search
CPC ..... B65D 51/247; B65D 51/28; B65D 51/24; B65D 2201/00
USPC ..... 220/23.875
See application file for complete search history.

(56) References Cited

U.S. PATENT DOCUMENTS

| | | | | |
|---|---|---|---|---|
| 5,725,122 A * | 3/1998 | Murphy | B65D 43/0212 | 206/508 |
| 8,727,149 B1 * | 5/2014 | Reid | B65D 41/26 | 215/228 |
| 2007/0014898 A1 * | 1/2007 | Spirk | B65D 1/22 | 426/106 |
| 2008/0041861 A1 * | 2/2008 | Crawford | B65D 25/2897 | 220/697 |

(Continued)

FOREIGN PATENT DOCUMENTS

| | | |
|---|---|---|
| DE | 202007012589 | 1/2008 |
| EP | 2527265 | 11/2012 |
| FR | 2731986 | 9/1996 |

OTHER PUBLICATIONS

Written Opinion of the International Searching Authority for International Application No. PCT/EP2015/069476 dated Oct. 23, 2015.

*Primary Examiner* — Ernesto Grano
(74) *Attorney, Agent, or Firm* — K&L Gates LLP

(57) ABSTRACT

An infant formula container is provided with a particular lid having transparent, translucent and non-transparent/translucent parts. The container has a compartment intended to receive an object. The compartment has a bottom wall having a light reflective surface. The container of the invention provides for enhanced visibility through the lid such as to render the object in the compartment identifiable but not fully visible.

16 Claims, 8 Drawing Sheets

(56) References Cited

U.S. PATENT DOCUMENTS

| | | | | |
|---|---|---|---|---|
| 2012/0205376 | A1* | 8/2012 | Yang | B65D 51/246<br>220/212 |
| 2014/0299598 | A1* | 10/2014 | Irani | B65D 51/247<br>220/212 |
| 2015/0129597 | A1* | 5/2015 | McBroom | B65D 43/169<br>220/324 |

* cited by examiner

INFANT FORMULA CONTAINER WITH COMPARTMENT AND LID

CROSS REFERENCE TO RELATED APPLICATIONS

The present application is a National Stage of International Application No. PCT/EP2015/069476, filed on Aug. 26, 2015, which claims priority to European Patent Application No. 14182844.2, filed Aug. 29, 2014, the entire contents of which are being incorporated herein by reference.

FIELD OF THE INVENTION

This invention relates to the field of packaging elements, especially containers and more especially containers such as cans or tins for infant formula. The packaging has specific features promoting and enhancing particular functions of the container.

BACKGROUND TO THE INVENTION

While breast feeding remains of ultimate importance and human breast milk is the most appropriate nutritional composition for infants, infant formula are necessary products in our modern world, especially for those infants and young babies not able to receive human breast milk.

Infant formula and more generally nutritional compositions are generally in the form of a dry powder or a liquid. The powder are typically intended to be reconstituted with water (sometimes with milk). They are usually intended to provide the intended subject (infant, toddler, baby, young child, teenager or even adult) with a significant amount of nutritional compounds, fulfilling a part, most or all of the nutritional needs of the subject. In the case of infant formula for young infant (especially between 0 and 6 months) the nutritional compositions provide for all the nutritional needs of the infant.

In that context, it is needed to make sure the subject receive the most appropriate dosage of the nutritional composition. Such dosage is usually indicated on the packaging (interior or exterior) and most be readable to all users (for example via text or visual graphics/drawings). Tools to help the correct dosage may be provided with the container (e.g. measuring spoon, dosage bowl, . . . ).

Generally significant pieces of information must be provided to the user, given the sensitivity of the nutritional needs.

In most countries, the information displayed on the packaging (especially the exterior) is regulated. Such information should be exact and complete. However the information should not appear to unduly promote the use of infant formula and be detrimental to the breast feeding of the infant (which shall always remain the best option). The use of picture, drawings, advertising can therefore be strictly regulated.

Provided the importance of the nutritional needs, it is of importance to provide safe packaging that enhance the perception of safety and security while providing an overall impression of good quality. It is indeed of ultimate importance to reinsure the parents of infants when they use the products. The shape, the material, the structure of the container is therefore critical for the quality and convenience. For example the container should be air and humidity-tight (avoiding spoilage of the content), while being easily openable and reclosable. Tamper-evidences feature may be provided as well. Convenience of use is also critical.

In that context, it is also of importance to clearly indicate at first sight the presence of sufficient information and/or the presence of helping tools in the container.

There is a need for a container, especially an infant formula container, that is safe, convenient and enhance the quality perception of the overall product.

There is a need for a container that provide information on its content and/or helping tools (such as dosing tools) in a way that is safe and convenient.

There is a need for a container which remain of good visual appearance over the production, handling and use steps. There is also a need for a container that enhance the good feeling of the user about safety (for example the product being safely enclosed and protected by the packaging) while providing reinsurance that the container encloses all necessary features and information for a convenient use of the container.

There is a need for a packaging that remains within the regulations and best practices, especially as for the permitted displayed information and safety features.

There is finally a need for a container that solve all or most of the above problems in the most convenient, safe, economical way.

SUMMARY OF THE INVENTION

An infant formula container is provided. It comprises

- A body defining an interior cavity open at one open-end. The cavity is configured to be able to contain a powdered or liquid product (such as an infant formula),
- A lid able to fully cover said open-end of the container such as to removably close the container
- A compartment inside the cavity, the compartment having one open-end, the compartment having a bottom wall separating the compartment from the rest of the cavity and optionally having at least one side wall, the open-end of the compartment being adjacent or juxtaposed or corresponding to the open-end of the container.

The container is characterized in that the lid has part transparent to visible light and optionally a translucent part, each covering at least a portion of the surface of the lid, and at least one of the bottom or side wall has a light-reflective surface in regard to the visible light.

The container is in particular safe, convenient, visually of high quality and complete. It especially allows for high visibility of any objects placed inside the compartment, without making then fully visible.

DETAILED DESCRIPTION OF THE INVENTION

Definitions

Figure 1:
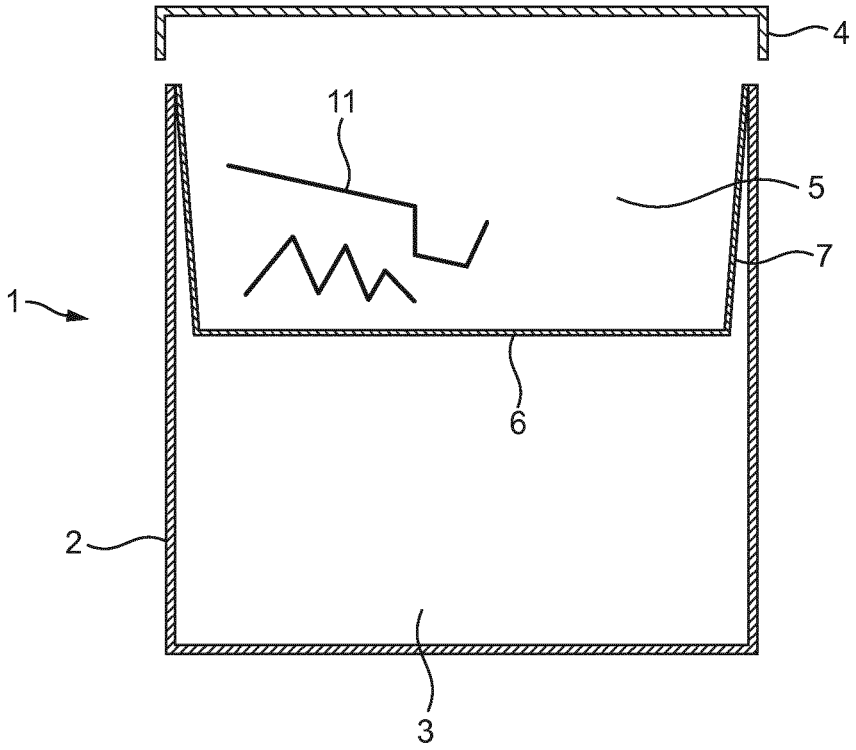
FIG. 1 shows a typical container of the invention.

In this specification, the following terms have the following meanings:

"Infant formula" conventionally refers to complete nutritional compositions intended for infants, especially for those of less than 6 months of age. For the purpose of the present invention however the term "infant formula" refers to any nutritional composition intended for infants/toddlers/babies/young children between 0 and 5 years of age. The unifying concept being that (a) the conventional packaging form for these nutritional compositions is usually similar or very close between 0 and 5 years of age and (b) the nutritional compositions for these ages are all intended to cover all or most of the nutritional needs of the subjects, and (c) typically the nutritional compositions are all in the form of a powder or a liquid. In particular "infant formula container", as used in the present application, refers to the type of container typically used for infant formula (for infants between 0 and 6 months) but also applicable to nutritional formulations for older children. The "infant formula container" of the present invention is in no way limited to the strict definition of "infants" (i.e. infants between 0 and 6 months of age). The infant formula container of the invention however has the characteristics of the typical container designed to contain infant formula in terms of usual dimensions, tightness to air, humidity and liquids, rigidity of the container, safety of use etc. . . . In some instances the infant formula container of the invention applies to any type of nutritional compositions, even those intended for adults (for example powdered compositions for sick adults). In one instance the container of the invention applies for infant formula and follow-on formula. In one instance also for growing up milks. In one instance the container applies only to infant formula.

"normal daylight conditions": refers to conventionally defined daylight conditions both in terms of light intensity and spectrum (color temperature). Typically normal daylight conditions have color temperature between 5500 and 6500 K and illuminance (light intensity) of between 2'000 and 20'000 Lux.

"LRV" is the acronym for Light Reflectance Value. It characterizes the property of a surface of a material as for its property to reflect the light. Conventionally the Light Reflectance Value (LRV) is the total quantity of visible and useable light reflected by a surface in all directions and at all wavelengths when illuminated by a light source. (ref. British Standard BS 8300:2001/A1:2005). LRV is expressed as a % on a scale from 0% to 100%. Zero assumed to be an absolute black and 100% being an assumed perfectly reflective white. The average blackest black has typically a LRV of between 0% and 5% and the whitest white between 85% and 100%. LVR values are measured by conventional well described methods.

"Visible light" conventionally refers to the part of the light spectrum that is visible to the naked human eye, i.e. with wavelengths from about 380 nm to 780 nm.

"Transparent": the term refers to the property of a material to permit the passage of light in the visible spectrum without significant diffusion so as to allow the human naked eye to see through the material while enabling to clearly identify an object or read a text through the material.

"Translucent": the term refers to the property of a material to let the light, especially in the visible spectrum, traverse the material while diffusing it in multiple directions. Conventional dictionaries, in line with this definition indicates "transmitting and diffusing light so that objects beyond cannot be seen clearly". Typically a translucent surface allows the human naked eye to see through the material without being able to clearly identify an object or read a text through the material.

"Light reflective surface": the term indicate the property of the surface to reflect the light in a significant way, i.e. to absorb only a small proportion of the light. It refers to the reflection of the light in the visible wave length/spectrum. Typical examples of light reflective surfaces are mirror surfaces, polished metal surfaces, brilliant polymeric surfaces, white surfaces, glossy surfaces such as a typical aluminium or tinplate surface.

DETAILED DESCRIPTION OF THE INVENTION

The infant formula container (1) of the invention can be made of any suitable material for the purpose of containing, isolating and protecting a sensitive product such as an infant formula. Typically an infant formula container has a body made of (or comprising) tinplate, steel, aluminium, laminate material comprising polymeric film(s), cardboard, paper, synthetic polymer(s) such as polyethylene, PVC, polyvinyl or polypropylene, or combination thereof. In common instances and preferably the container body is made of steel. The overall shape of the container is typically cylindrical or parallelepipedic. Typically the material of the container is tight to air and liquid and has a sufficient resistance to tears. Typically the external surface of the body is painted or printed with colours, text and/or graphics.

The interior side of the container defines a cavity (3) in which the intended product can fit. The container has at least one or exactly one opening allowing to dispense the product when the container is in a dispensing configuration. The opening can be covered by a foil, such a steel, cardboard, tinplate, laminate or aluminium-foil that can serve to further isolate the product before the first opening of the container. The foil can be removable fully or partially, for example to protect the content during repeated sue.

The container comprises a lid (4). Such lid can be made of any suitable material. Typically the lid is made of plastic, polymeric resin (polyethylene, polypropylene, polyvinyl, PCV or the like), steel, tinplate or aluminium. The lid can be operated to fit and close the opening or open-end of the container when needed. The lid can be articulated and physically linked to the container or it can be provided as a separate part. Preferably the lid, when in place, tightly close the container. The lid typically has a flat or substantially flat surface and a rim. The rim can engage onto the part of the body of the container that is next to the opening or open-end, to insure safe closing. Additional closing means can be provided, for example: a lock to secure the lid in place onto the container, a hinge or a pivot to articulate the lid. The lid and/or the container body can be provided with additional features such as tamper-evidence features to signal whether the container has already been opened. In one embodiment the tamper-evidence feature is an integral part of the rim of the lid that can tear off. The lid is configured to be able to cover the open-end of the container and to removably close the container.

Compartment:

The container is provided with a compartment (5). The compartment has an open-end and a bottom wall. Optionally the compartment has a side wall. The bottom wall (6) separates the compartment from the rest of said cavity. The open-end of the compartment is adjacent or juxtaposed or corresponds to the open-end of the container. The open-end of the compartment provide access to the interior of the compartment. In one embodiment the open-end of the compartment covers a majority or all the surface of the open-end of the container, in such a way that the product enclosed in the cavity is accessible only and mainly through the compartment. Typically the compartment or the bottom wall of the compartment can be removed or displaced such as to allow the access to the product inside the body (or cavity) of the container. In one embodiment the bottom wall can be peeled-off and/or removed to render the product accessible through the open end of the container. In one embodiment the bottom wall is removably attached to the compartment or to the container body.

Walls:

The bottom wall (6) and/or the side wall (7) can be made of any suitable material. Preferably the wall(s) are made of or comprise a thin foil such a polymeric foil or an aluminum foil. The bottom wall can have a substantially flat surface. Alternatively the bottom wall can be "curved" such as to define a rounded compartment. The side walls can be separated or merged with the corresponding body part. Most preferably the bottom wall (or the side wall or both) is made of or comprises aluminum.

In one embodiment the bottom wall (6) defines a plan and is substantially flat. The plan is substantially parallel to the lid (4) when said lid is in the closed position The bottom wall (6) 8 or the side wall, or both) can have a structure extending perpendicularly to the surface of the bottom wall (respectively side wall) such as to reflect the light passing through said lid in multiple directions. The structure is preferably present at the surface of the wall(s) facing the interior of the compartment. Preferably such structure has an average elevation of less than 1 mm (or less than 0.5 mm or less than 0.2 mm) above the plan of the bottom wall (6) (respectively side wall). Such structure can be for example embossed onto the material. In one embodiment the wall(s) are made of an aluminium foil that has embossed structures at its surface. In on the embodiment the wall(s) is/are made of or comprise tinplate possibly in combination with aluminium Such structures can for example be conical, square or round. By reflecting and/or diffusing the light in multiple directions the structure illuminates any object located inside the compartment in a more uniform way (compared to the absence of structure).

In one embodiment the bottom wall (6) and/or the optional side wall (7) of the compartment (5) fully separate(s) the part of the cavity intended to contain the product from the open-end of the container.

Product:

The product intended to be placed in the container of the invention can be a powder (dry-powder) or a liquid, preferably nutritional compositions. Examples are infant formula, follow-on formula, growing-up milk, cereal powders etc. . . . The powder can be fine and uniform and can incorporates pieces. In one embodiment the product is, in its form, similar to infant formula but is a nutritional composition intended for adults, especially a powder.

Lid:

The lid (4) of the container can comprise:

a transparent part (8)

a translucent part (9)

a non-transparent/translucent part (10).

The non-transparent/translucent part can cover the remainder of the surface of the lid not covers by the transparent part of by the translucent part.

The parts (8, 9, 10) can be made of the same material or can be of different material. In one embodiment the parts (8,9,10) are made of the same overall material but are surface-treated differently to absorb/reflect light differently. In one embodiment the material of 1 or 2 parts differs from the material of the other part(s).

In one embodiment the transparent or the translucent parts (8,9) of the lid (4) cover individually at least 20%, 30%, 40%, 45%, 50%, 60%, 70%, 80% 90%, 95%, or 100% of the total surface of said lid.

In one embodiment the transparent and translucent parts (8,9) of the lid (4) cover in total at least 20%, 30%, 40%, 45%, 50%, 60%, 70%, 80% 90%, 95%, or 100% of the total surface of said lid (=addition of the surface areas of the translucent part and of the transparent part).

In one embodiment the surface areas are as follows:

transparent part: 13% translucent part: 34% non transparent/translucent part: 53%

(all expressed as % of the surface are of the lid).

The higher the surface area of the transparent and/or translucent part (individually or in total), the higher the amount of light that will be enable to traverse the lid and illuminate any object placed inside the compartment.

In one embodiment the surface area of the transparent part is smaller than the surface area of the translucent part. In one embodiment it may be preferable to provide relatively limited or smaller surface area for the transparent part (relatively to the surface area of the translucent part or to the total surface area of the lid) as this helps to partly mask the full visibility of object (or readability of the information/leaflet/text).

In one embodiment the surface area of the non-transparent/translucent part is smaller than the surface area of the translucent part, the transparent part or both.

In one embodiment the surface area:

of the transparent part is between 5% and 25%, preferably 10% and 20%, of the surface area of the lid, and/or of the translucent part is between 20% and 70%, preferably 30% and 60%, of the surface area of the lid, and/or of the non-transparent/translucent part is between 5% and 75%, preferably 20% and 60%, of the surface area of the lid.

The different light properties of the parts (8,9,10) can be achieved by any conventional treatment in particular affecting the structure of the surface of the part (for example, in case of injection of a polymer into a mould to form the lid, various surface treatment or structure of the mould, various injection temperature, various additives etc, . . . ).

In one embodiment the transparent or translucent parts (8, 9) of the lid (4) has a circular or oval shape. The non-transparent/translucent part (10) can be positioned at the periphery of said lid and/or any or both of the transparent (8) or translucent part (9) can be centrally positioned on the lid (4).

In one embodiment the non-transparent/translucent part is in the shape of a external ring (adjacent to the edge of the lid), the transparent part is in the shape of a ring and is adjacent to and at the inner side of the non-transparent/translucent, and the translucent part is in the shape of a circle, centrally located on the lid.

In one embodiment the lid (4) comprises a transparent part (8) and a translucent part (9), the translucent part (9) is centrally positioned (on the lid) and surrounded by the transparent part (8).

In one embodiment the lid (4) comprises a transparent part (8) that covers between 20% and 50% of the total surface of the lid (4).

In one embodiment the lid (4) comprises a translucent part (9) that covers at least 50% of the surface of the lid (4).

In one embodiment the lid (4) comprises a non-transparent/translucent part (10) surrounding said transparent part (8) and said translucent part (9).

In one embodiment the surface area of said translucent part (9) is at least twice as big as the surface area of said transparent part (8).

In one embodiment the surface area of the non-transparent/translucent part (10) is at least twice as big as the surface area of the transparent part (8).

The embodiment described above (and generally in the present document) can be combined.

Light-Reflective Surface:

At least one of the bottom (6) or side wall (7) has a light-reflective surface in regard to the visible light. The surface considered is the surface of the wall orientated toward the interior of the compartment. The light reflective property can be provided by the material itself (such as aluminium, tinplate, . . . ) or by the (surface)-treatment of the material of the wall (prints, paints, polymer surfacing, polishing etc, . . . ). The light reflective surface is able to reflect the (visible) light and hence render any object inside the compartment more illuminated and/or visible to the naked eye of a human (especially under normal day-light conditions). Conventional light reflective surface are known (such as the surface of a most conventional aluminium foil or the surface of a tinplate) and easily distinguishable from non-reflective surfaces (such as matt paints, matt polymer, dark polymers etc . . . ). Typical light reflectance (LRV value) of a the surface of an aluminium foil can be around 70% or above 60%, or above 80%. Typically light reflectance (LRV value) of a the surface of tinplate can be around 60% or above 50%, or above 70%.

In one embodiment the light reflective surface is the surface of the inner part of the body of the container that is accessible by the light through the lid.

In one preferable embodiment the light reflective surface of the invention is the surface of the bottom wall and/or of the side walls.

The light reflectance of the reflective surface or of the surface of the wall(s) can be measured by a conventional LRV value. In one embodiment the LRV value of the bottom wall or the side wall or both is equal or higher to 40%, or 50%, or 60% or 75% or 80%. In one preferable embodiment the LRV value of the light reflective surface and/or the bottom wall (or side wall, or both) is higher than 60% or more preferably 75%, which correspond to a surface of high reflectance and enables any object inside the compartment to be more illuminated than with a conventional polymeric or colored or printed surfaces, especially matt surfaces (under normal daylight conditions).

Light Transmission:

The transparent part (8) and/or the translucent part (9) of the lid can have a light transmission rate of at least 60% or 70% or 80% or 90%. Such light transmission measures how much light (in the visible spectrum) is able to traverse the part of the lid. The method is a conventional method. The value is dependent of the material of the part of the lid and of its thickness. Typically an opaque solid material will have a light transmission rate of 0% (absolutely opaque) to 10% to 15% (almost opaque). A fully transparent material (glass) has typically a light transmission rate between 90% and 100%. Translucent material (such has de-polished glass) can have a light transmission rate of for example 70% to 90%. Preferably the light transmission rate of the transparent part is higher than the light transmission rate of the translucent part. In one embodiment the light transmission rate of the transparent part is between 75% and 95% and/or the light transmission rate of the translucent part is between 60% and less than 75%.

The non-transparent/translucent part (10) typically has a relatively lower light transmission rate than the transparent part (8) and/or the translucent part (9). In one embodiment the light transmission rate of the non-transparent/translucent part (10) is below 40%, below 30%, below 20%, below 15%, below 10% or below 5%.

In one embodiment the light transmission rate of the non-transparent/translucent part of the lid is lower than the light transmission rate of the transparent part of the lid.

In one embodiment the light transmission rate of the non-transparent/translucent part of the lid is lower than the light transmission rate of the translucent part of the lid.

In one embodiment the light transmission rate of the non-transparent/translucent part of the lid is lower than both the light transmission rate of the transparent part of the lid and of the translucent part of the lid.

In one embodiment the light transmission rate of the translucent part of the lid is exactly equal than the light transmission rate of the transparent part of the lid, or within +/−20% of it.

Object

The infant formula container (1) of the invention can comprise at last one object (11) positioned in the compartment. Such object can be for example a spoon (especially a dosing spoon for the nutritional product), a teat, and/or a printed material such as a leaflet (especially comprising information about the use of the nutritional composition), a dosing device, or any useful object. It is usually of importance that the object(s) are provided inside the container and that they are separated in the container from the nutritional product (for hygiene and accessibility reasons for example). It is also desirable that the object(s) are directly accessible through the lid, without displacement of the nutritional product. For convenience and perception it is even better if the object(s) is/are visible through the lid when the lid is in the close position before or after the first use. In one embodiment the object(s) is/are visible at least partially through the lid. In one embodiment the container comprises one single object positioned in the compartment. In one embodiment the container comprises 2, 3, 4, 5 or multiple objects positioned in the compartment. In case of multiple objects (2 or more) the concept of the invention enhancing the visibility of the object(s) is even more beneficial as the objects are naturally less visible because of their multiplicity.

In one embodiment of the invention the object however is recognisable to a human adult naked eye while not being fully visible under normal daylight conditions. In the case of a printed material or leaflet or sheet (for example comprising information on the product) the printed material/leaflet may be recognisable but not readable or not easily readable through the lid. This effect is achieved by the combination of the various part of the lid, their light transmission properties (translucent, transparent, non-transparent/translucent), and/or their position and arrangement on the lid surface.

This may be of particular importance when there exist some legal restriction on the type of information that is displayed on the container. For example some of the information printed on the printed material/leaflet may be necessary or informative to the consumer but may be prohibited on the external surface of the container (as it may be considered as undesirable advertising). The displaying of an infant picture or infant face may be undesirable on the container but necessary on the information leaflet to visually indicate how to feed the infant with graphic illustration.

As such, the combination of the part of the lid, with their respective light properties renders the presence of the object visible (reinsuring for the consumer) while keeping the complete information not fully visible.

In one embodiment the infant formula container (1) of the invention:

- is substantially cylindrical,
- the bottom wall (6) and side wall (7) of the compartment (5) is/are made of aluminium or tinplate or combination thereof,
- the lid has central translucent part (9), a transparent part (8) surrounding the translucent part (9) and non-transparent/translucent part (10) surrounding the transparent part (8) and reaching the periphery of the lid,
- an nutritional composition powder in located in the cavity (3),
- a spoon (11) and/or a printed material or leaflet (11) is/are located in the compartment,
- the transparent (8), translucent (9) and non-transparent/translucent (10) parts are dimensioned and configured such as to render the spoon or printed material/leaflet (11) identifiable but not fully readable/visible through the transparent part (8) of said lid (8) by the naked eye of an adult human under normal daylight conditions.

Advantages of the Invention

The combining the above described features the inventors have identified a way to provide an advantageous infant formula container.

The combination of the various parts of the lid (transparent, translucent, non-transparent/translucent), their differential light transmission properties, their configuration and their location on the surface of the lid allow for and enhance the visibility of any object placed inside the compartment. However visibility is enhanced while advantageously preventing the full and complete visibility. For example the inventor have found that the user and buyer of the container is reinsured by visibly identifying the presence of—for example—a dosing spoon in the compartment. However the inventors have also found that the user/consumer is also comforted by the absence of full visibility of the spoon (unconsciously this indicates that the spoon is fully enclosed and securely contained in the compartment, i.e. safe for use). As explained above, the restriction of the full visibility of the information placed in the compartment (on a printed leaflet or sheet) can also be a legal requirement.

Transparent surface are very susceptible to alterations and damages. Such alterations can include scratches or bumps for example created during the manufacturing, packaging, handling or delivery of the container. The translucent surfaces are less susceptible to visible damages or alterations (the translucency of the surface masking the damages). The presence on the lid of the container of the invention of a combination of a transparent part together with a translucent part (and a non-transparent/translucent part) allows for enhanced quality impression and less visible damages.

Similarly the wall(s) is/are typically made of relatively soft material (aluminium foil and/or tinplate for example). The walls are then very susceptible to small damages or alteration during the manufacturing process (dents, scratches, etc, . . . ). The combination of the various parts of the lid as define by the present invention tend to mask the small defects of the walls and enhance the overall quality and perceived quality impression.

The presence of a light reflective surface in the compartment (at the bottom wall for example) allows for a better utilization of the light passing through the lid to illuminate any object placed in the compartment. The inventors have found that the better illumination, although a relatively small gain in numerical values (in comparison to non-reflective surfaces) enhances not only the visibility of any object placed in the compartment but also enhances the quality impression delivered by the overall container.

Altogether the features described in the present document are advantageously combined to deliver a better container.

Examples of Containers of the Invention

FIGS. 1-6, alone or in combination with the features described above provide examples of the invention.

Light Testing

Figure 2:
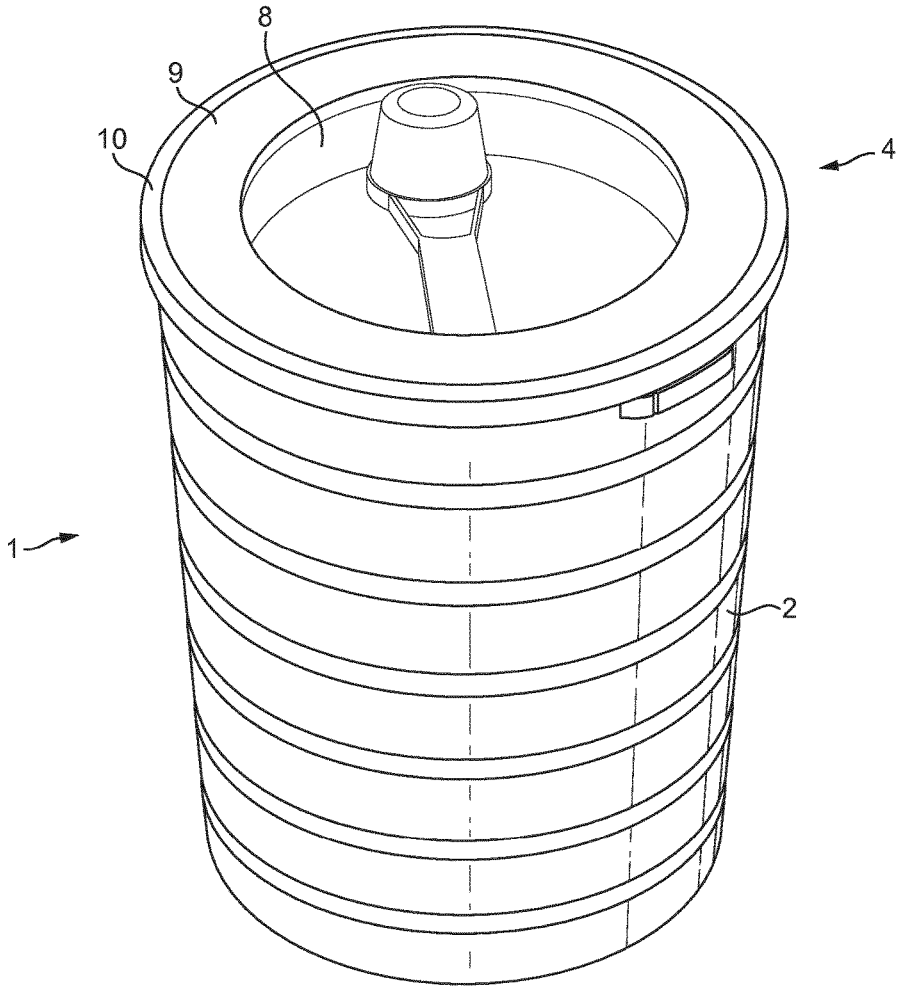
FIG. 2 shows a typical container of the invention, in a perspective view and with an object (a spoon and a folded printed material/leaflet) in the compartment.
Figure 3:
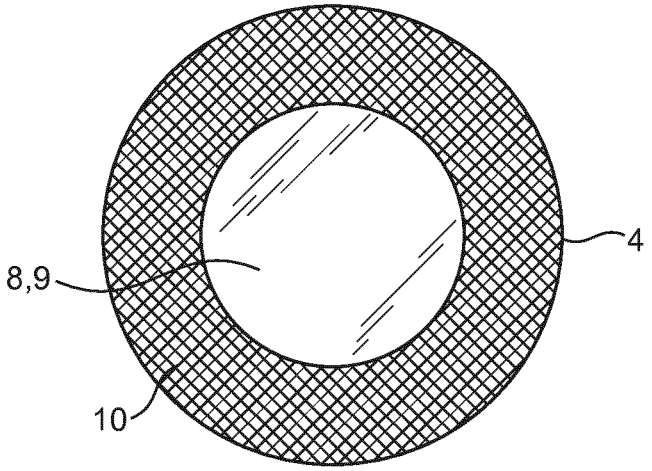
FIG. 3 shows a typical lid for the container of the invention.
Figure 4:
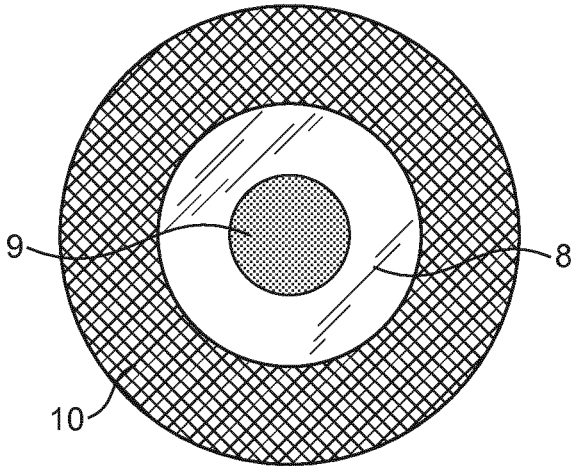
FIG. 4 shows a typical lid for the container of the invention.
Figure 5:
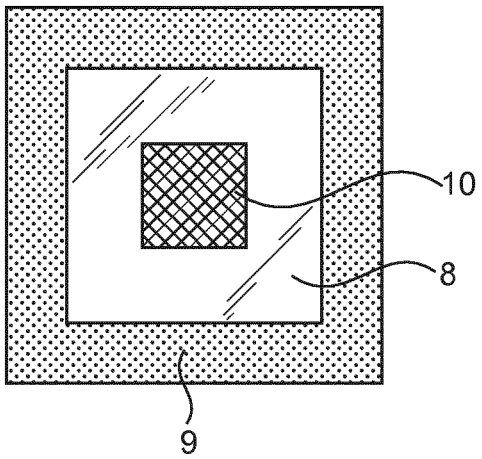
FIG. 5 shows a typical lid for the container of the invention.
Figure 6:
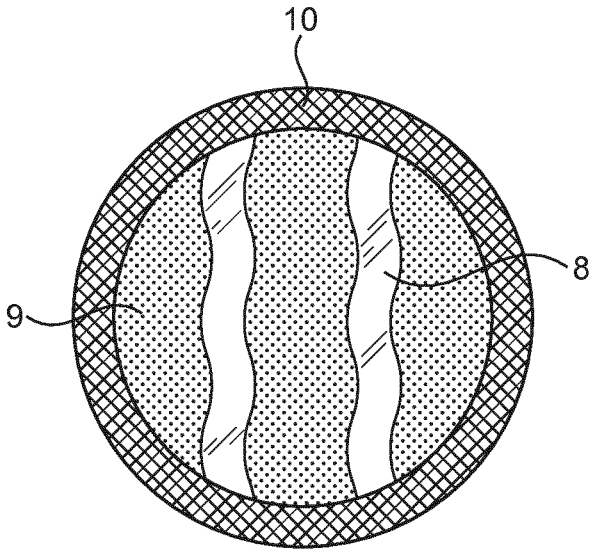
FIG. 6 shows a typical lid for the container of the invention.

A container as illustrated by FIG. 2 was used for the experiment in combination with different types of lids and different surface of the bottom wall of the compartment. Conventional plain lids were made of plain polymeric material, of either white, gold or grey color.

The lids of the container of the invention were also tested (coded "C2-lid"). The C2-lids were made of were polymeric material, with an external non-transparent/translucent part, a transparent part and a translucent part. The translucent part is centrally located on the lid and the transparent part located in between the 2 other parts on the lid (concentric arrangement). The C2 lids (lids of the invention) have ring-shaped transparent part and non-transparent/translucent part, as per FIG. 4. The C2-lids of the invention were combined with either white or grey non-translucent/transparent area. All other characteristics and dimensions of the lids were the same.

The surface area of the non-transparent/translucent part of the C2 lids was: 53%

The surface area of the transparent part of the C2 lids was: 13%

The surface area of the translucent part of the C2 lids was: 34% (all expressed as % of the surface area of the lid)

The radial dimension of the non-transparent/translucent part of the C2 lids was: 16 mm The radial dimension of the transparent part of the C2 lids was: 5.5 mm The radial dimension of the translucent part of the C2 lids was: 30 mm (the radial dimension being the width of the area along the radius of the lid)

The total diameter of the lid of 103 mm (Radius of 51.5 mm) to fit container of diameter 99 mm.

The containers, with the lids in place, were illuminated by a light source providing uniform normalized daylight conditions (the light source and light intensity was the same in all experiments). The light transmitted through the lid, reflected by the bottom and side walls and retransmitted through the lid was measured. A sensor was placed at various positions on the lid and the received light power was measured by a sensor. The sensor a "StellarNet Miniature Spectrometer". The sensor measures the light power in Watt/$m^2$ over the light spectrum of 190 nm to 1083 nm. The measurement was done in the transparent part, the translucent part and the non-transparent/translucent part of the lid.

The value were weighted by the surface area covered by each part and the weighted average is reported.

Figure 7A:
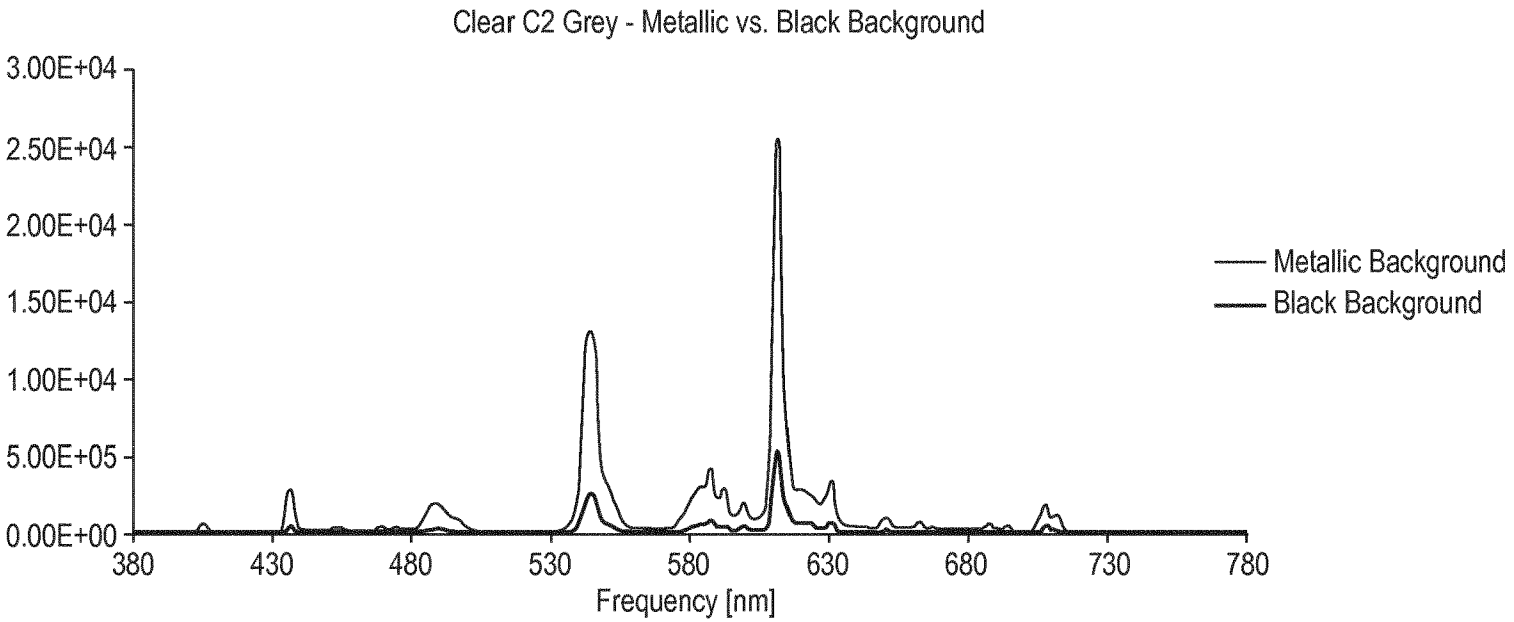
FIG. 7 shows the light reflection through a conventional grey lid (FIG. 7A) and a corresponding grey lid of the container of the invention (FIG. 7B).
Figure 7B:
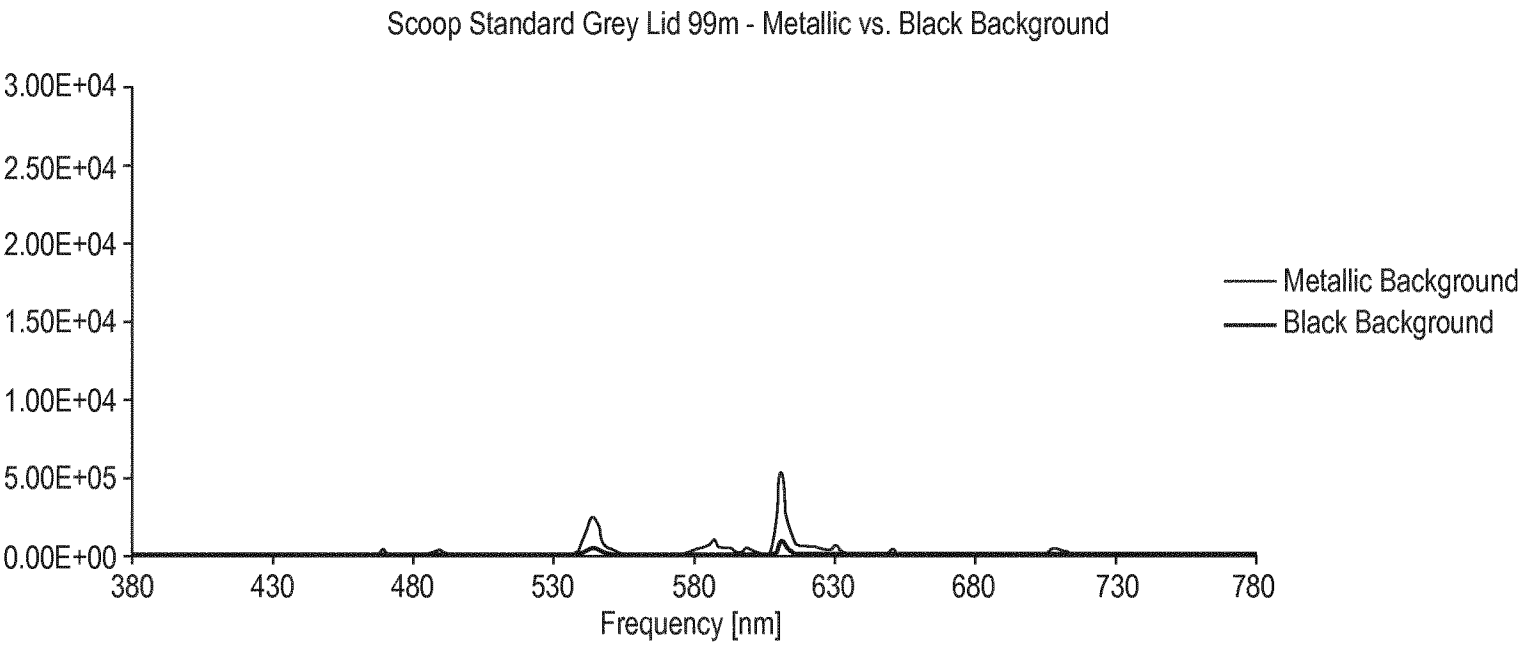

FIGS. 7A and 7B show the light transmission measurements for respectively a C2-lid and a conventional lid, each associated with either a metallic (i.e. aluminium) bottom wall (so called background) or a black bottom wall. The color of the lids (respectively the non-transparent/translucent parts of the lids) was grey.

Figure 8A:
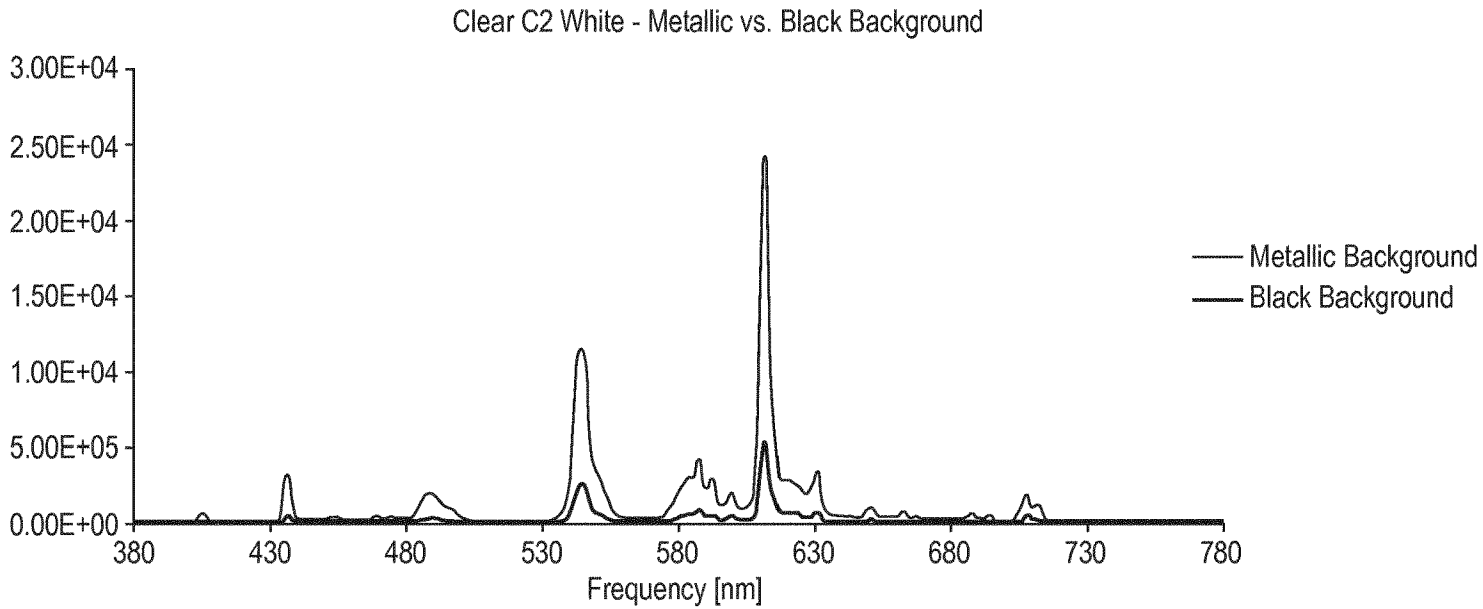
FIG. 8 shows the light reflection through a conventional white lid (FIG. 8A) and a corresponding white lid of the container of the invention (FIG. 8B).
Figure 8B:
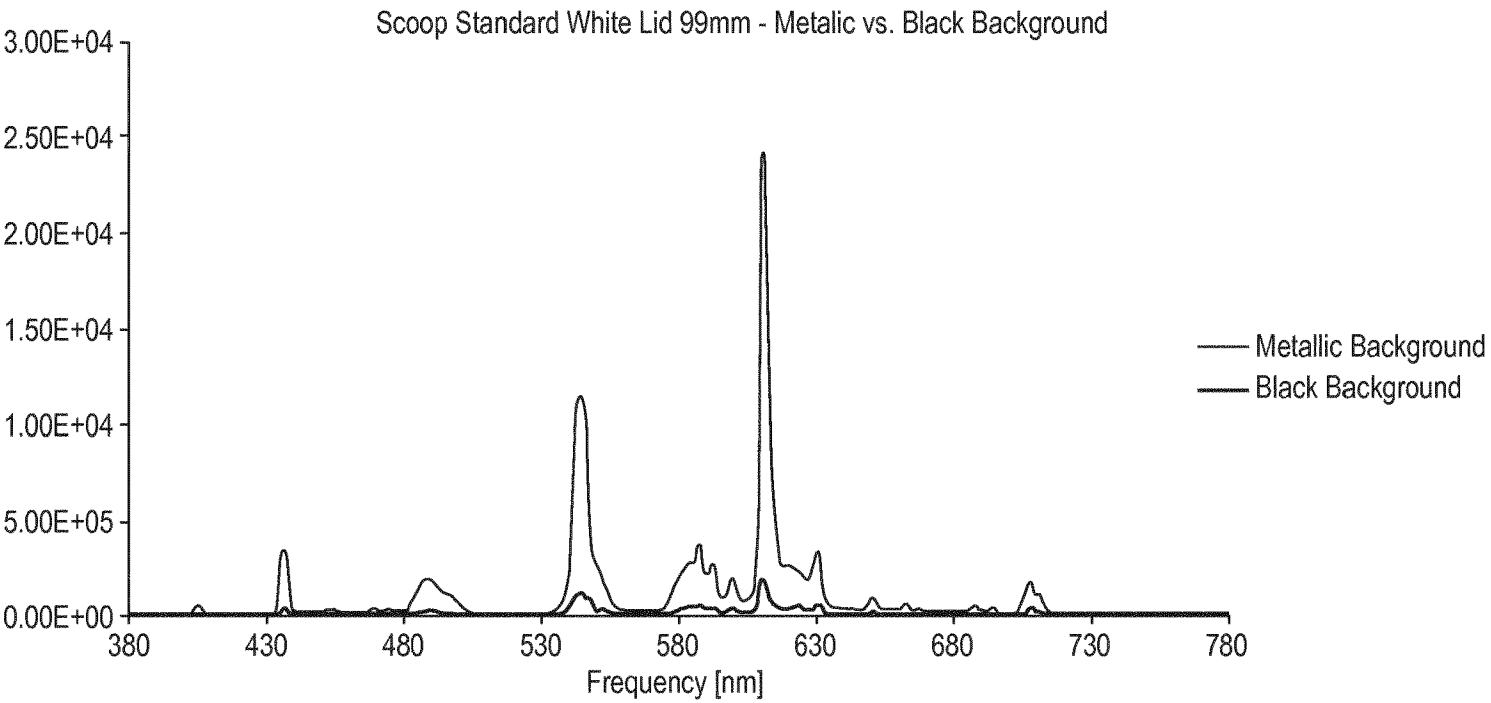

FIGS. 8A and 8B shows the same for white lids.

Effect of a light reflective surface-Effect of Transparent/translucent parts on the lid Comparison between the amount of light measured for conventional lid and C2-lid (FIGS. 7A versus 7B and 8A versus 8B respectively) shows that the presence of the C2-lid features (transparent part, translucent part) dramatically enhance the amount of light available in the compartment. Indeed the light values for the figures "A" are much higher than for the figures "B".

Moreover for each of the figures the light values for the "metallic background" are much higher than the light values for the "black background". This illustrates the significant enhancement the of amount of light in the compartment when a "metallic background" is used (the "metallic background" was the bottom wall of the invention made of an aluminium foil).

Also and importantly, the FIGS. 7A, 7B and 8A, 8B shows that the absolute maximum amount of light in the compartment is achieved with the combination of the C2-lids of the invention (having transparent and translucent parts) with the "metallic background" (i.e. the bottom wall of the invention made of an aluminium foil). The indicates that any object placed inside the compartment of the invention would have the best illumination (i.e. visibility).

The light transmission rate of the grey and gold-colored lids were tested at various positions of their surfaces (standard method):

| | Light transmission (%) |
|---|---|
| Conventional plain lid, grey (non-transparent/translucent) | 3.54% |
| Conventional plain lid, gold (non-transparent/translucent) | 12.02% |
| C2-lid, grey, non-transparent/translucent area | 8.83% |
| C2-lid, gold, non-transparent/translucent area | 10.05% |
| C2-lid, grey, transparent area | 84.33% |
| C2-lid, gold, translucent area | 86.99% |

The invention claimed is:

1. An infant formula container comprising:

a body defining an interior cavity open at one open-end, the interior cavity configured to be able to contain a powdered or liquid product;

a lid able to fully cover the open-end of the container to removably close the container;

a compartment inside the interior cavity, the compartment having one open-end, the compartment having a bottom wall separating the compartment from the rest of the interior cavity, the open-end of the compartment being at least one of adjacent to the open-end of the container, juxtaposed to the open-end of the container, and corresponding to the open-end of the container;

the lid has a transparent part that is transparent to visible light, the transparent part covering at least a portion of a surface of the lid, the lid further comprises a translucent part centrally positioned and surrounded by the transparent part, and the lid further comprises a non-transparent/non-translucent part having a light transmission rate below 20%, the non-transparent/non-translucent part is a first ring adjacent to an edge at the periphery of the lid, the transparent part is a second ring adjacent to and at the inner side of the non-transparent/non-translucent part, and the translucent part is a circular portion centrally located on the lid; and a light-reflective surface with respect to visible light, the light-reflective surface is positioned in at least one component selected from the group consisting of the bottom wall of the compartment and a side wall of the compartment.

2. The infant formula container of claim 1 wherein the light-reflective surface has a reflectance equal to or greater than 50%.

3. The infant formula container of claim 1 wherein at least one of the transparent part or the translucent part has a light transmission rate of at least 60%.

4. The infant formula container of claim 1 wherein the transparent part of the lid covers in total at least 40% of the total surface of the lid.

5. The infant formula container of claim 1 wherein at least one of the bottom wall or the side wall comprises or is made of aluminium or tinplate or combination thereof.

6. The infant formula container of claim 1 wherein the container comprises at least one object positioned in the compartment, the at least one object being at least partially visible through the lid.

7. The infant formula container of claim 1 wherein the transparent part of the lid has a circular or oval shape.

8. The infant formula container of claim 1 wherein the bottom wall defines a plane and is substantially flat, and the plane is substantially parallel to the lid when the lid is in a position removably closing the container.

9. The infant formula container of claim 1 wherein the bottom wall has a structure and/or embossment extending perpendicularly to a surface of the bottom wall to reflect the visible light passing through the lid in multiple directions.

10. The infant formula container of claim 1 wherein the transparent part covers between 10% and 40% of the total surface of the lid.

11. The infant formula container of claim 1 wherein the translucent part covers at least 30% of the total surface of the lid.

12. The infant formula container of claim 1 wherein the surface area of the translucent part is at least twice as big as the surface area of the transparent part, and the surface area of the non-transparent/non-translucent part is at least twice as big as the surface area of the transparent part.

13. The infant formula container of claim 1 wherein the bottom wall of the compartment fully separates the part of the interior cavity intended to contain the powdered or liquid product from the open-end of the container.

14. The infant formula container of claim 1 wherein:

the container is substantially cylindrical, the bottom wall and the side wall of the compartment are made of aluminium and/or tinplate, the container comprises a nutritional composition powder in the interior cavity and comprises a spoon and/or a printed leaflet located in the compartment, and the transparent, translucent and non-transparent/non-translucent parts being dimensioned and configured to render the spoon or leaflet identifiable but not fully readable/visible through the transparent part of the lid by the naked eye of an adult human under normal daylight conditions.

15. The infant formula container of claim 1, wherein a top of the side wall of the compartment defines the open-end of the compartment, and the side wall of the compartment extends from the open-end of the compartment to the bottom wall of the compartment.

16. The infant formula container of claim 1, wherein the surface area of the transparent part is between 10% and 20% of the total surface area of the lid, the surface area of the translucent part is between 30% and 60% of the total surface area of the lid, and the surface area of the non-transparent/non-translucent part is between 20% and 60% of the total surface area of the lid.

* * * * *